US009753396B2

(12) United States Patent
Van De Straete et al.

(10) Patent No.: US 9,753,396 B2
(45) Date of Patent: Sep. 5, 2017

(54) IMAGE REPRODUCTION SYSTEM INCLUDING A COOLING UNIT FOR COOLING LIGHT EMITTING UNITS AND METHOD FOR USING SYSTEM

(71) Applicant: Xeikon Manufacturing N.V., Lier (BE)

(72) Inventors: Herman Jan Godelieve Van De Straete, Deurne (BE); Jurgen Norbert Bart Devlieghere, Borgerhout (BE)

(73) Assignee: Xeikon Manufacturing N.V., Lier (BE)

( * ) Notice: Subject to any disclaimer, the term of this patent is extended or adjusted under 35 U.S.C. 154(b) by 0 days.

(21) Appl. No.: 14/985,640

(22) Filed: Dec. 31, 2015

(65) Prior Publication Data

US 2016/0202663 A1 Jul. 14, 2016

(30) Foreign Application Priority Data

Jan. 14, 2015 (EP) ..... 15151121

(51) Int. Cl.

| | |
|---|---|
| ***G03G 21/00*** | (2006.01) |
| ***B41J 2/00*** | (2006.01) |
| ***F21V 29/00*** | (2015.01) |
| ***G03G 15/04*** | (2006.01) |
| ***G03G 21/20*** | (2006.01) |

(Continued)

(52) U.S. Cl.

CPC ..... *G03G 15/04054* (2013.01); *B41J 2/45* (2013.01); *B41J 29/377* (2013.01); *F21V 29/00* (2013.01); *G03G 21/20* (2013.01); *G03G 2215/0409* (2013.01)

(58) Field of Classification Search

CPC ..... G03G 15/04054; G03G 21/20; G03G 21/206; G03G 2215/0407; G03G 2215/0409; G03G 2215/0451; G03G 2215/0453; B41J 2/45; B41J 29/377; F21V 29/002; F21V 29/02; F21V 29/00; F21Y 2103/10

USPC ..... 399/32, 44, 92, 94, 220; 347/117, 118, 347/130; 362/218, 373

See application file for complete search history.

(56) References Cited

U.S. PATENT DOCUMENTS 5,191,353 A 3/1993 Corona
5,192,958 A * 3/1993 Charnitski ..... B41J 2/45 165/100

(Continued)

FOREIGN PATENT DOCUMENTS

EP 0629507 A1 12/1994
EP 2036734 A1 3/2009

*Primary Examiner* — Robert Beatty
(74) *Attorney, Agent, or Firm* — The Webb Law Firm

(57) ABSTRACT

A system for use in image reproduction, the system includes at least a first light emitting unit and a second light emitting unit. The first light emitting unit includes a first cooling means arranged for cooling the first light emitting unit. The second light emitting unit includes a second cooling means arranged for cooling the second light emitting unit independently of the first light emitting unit. The first light emitting unit has a first elongate emitting area. The second light emitting unit has a second elongate emitting area. A control unit controls the cooling of at least one of the first cooling means and the second cooling means such that at least one of the first elongate emitting area and the second elongate emitting area, respectively, has a desired length.

19 Claims, 3 Drawing Sheets

(51) Int. Cl.
*B41J 29/377* (2006.01)
*B41J 2/45* (2006.01)

(56) References Cited

U.S. PATENT DOCUMENTS

| | | | | |
|---|---|---|---|---|
| 5,519,430 | A | 5/1996 | De Cock et al. | |
| 5,751,327 | A | 5/1998 | De Cock et al. | |
| 5,784,666 | A * | 7/1998 | Nagase | B41J 2/45 347/232 |
| 6,113,212 | A | 9/2000 | Ng | |
| 8,368,735 | B2 | 2/2013 | Soulliaert et al. | |
| 2003/0007065 | A1 * | 1/2003 | Driessen-olde Scheper | B41J 2/45 347/238 |
| 2003/0234855 | A1 * | 12/2003 | Ng | B41J 2/45 347/238 |
| 2008/0232856 | A1 * | 9/2008 | Matsushita | G03G 15/326 399/220 |
| 2009/0073252 | A1 * | 3/2009 | Wiggins | B41J 2/45 347/247 |
| 2013/0302051 | A1 | 11/2013 | Shimba et al. | |

* cited by examiner

IMAGE REPRODUCTION SYSTEM INCLUDING A COOLING UNIT FOR COOLING LIGHT EMITTING UNITS AND METHOD FOR USING SYSTEM

CROSS-REFERENCE TO RELATED APPLICATIONS

This application claims priority to European Patent Application 15 151 121.9 filed Jan. 14, 2015, the disclosure of which is hereby incorporated in its entirety by reference.

FIELD OF THE INVENTION

The present invention is related to a system for use in electrophotographic image reproduction, such as printing or copying, wherein a latent image is formed on a photosensitive member by image-wise exposure to light using one or more light emitting units, and to a method for use in electrophotographic image reproduction.

BACKGROUND OF THE INVENTION

In a typical electrophotographic image reproduction process, first a latent charge image is formed on a pre-charged photosensitive member by image-wise exposure to light using a light emitting unit, e.g. a unit with a plurality of LED array ICs. This latent image is subsequently made visible on the photosensitive member with charged toner particles. Examples of a photosensitive member are a photoconductive drum or belt. The developed image is transferred directly or via one or more intermediate transfer members to a substrate, where it may be fixed simultaneously or subsequently.

In conventional electrophotographic systems often use is made of light emitting units including LED array ICs, to generate the light, combined with an optical system to focus the light on the photosensitive member. As e.g. disclosed in EP 629 507 and EP 2 036 734 in the name of the Applicant, a LED array is typically composed of a number of LED array ICs arranged on a carrier and connected, e.g. by means of wire bonding, to adjacently attached driver ICs. Usually the carrier also acts as a heat sink. The light generated by the light-emitting diodes, LEDs, is accurately focused on the photosensitive member by means of a lens block positioned between the LEDs and the photosensitive member.

Due to positioning errors and tolerances when mounting the LED arrays on the carrier, the length of the light emitting area of different light emitting units may be different. When light emitting units with different lengths are used in the same printing apparatus the image quality will be significantly decreased. To deal with such differences it is known to classify manufactured light emitting units in length classes. However, it can be easily understood that this creates problems with stock, exchangeability of the units, production requirements, etc.

SUMMARY OF THE INVENTION

It is an object of embodiments of the invention to provide a system and method for use in image reproduction which improves the image quality. More in particular it is an object of the invention to be able to deal, at least partly, with differences in length of a light emitting area of a first and a second light emitting unit of a printing apparatus.

According to a first aspect there is provided a system for use in image reproduction, said system comprising at least a first light emitting unit and a second light emitting unit, and a control unit. The first light emitting unit comprises a first cooling means arranged for cooling said first light emitting unit. The second light emitting unit comprises a second cooling means arranged for cooling said second light emitting unit independently of said first cooling means. The first light emitting unit has a first elongate emitting area, and the second light emitting unit has a second elongate emitting area. The control unit is configured for controlling the cooling of at least one of said first cooling means and said second cooling means such that at least one of said first elongate emitting area and said second elongate emitting area, respectively, has a desired length.

In other words, using such a system the length of the first and/or second light emitting area can be adjusted using the first and/or second cooling means. In that way it can be avoided that light emitting units need to be classified in length classes, and any length adjustments may be performed through the cooling means.

According to a preferred embodiment the control unit is configured for controlling the cooling of at least one of the first cooling means and the second cooling means such that the length of said first light emitting area is substantially equal to the length of said second light emitting area. In that way the image quality will be good, also when the first and second light emitting units have a different length (when at the same temperature), because the first and second cooling means will allow the first and second light emitting units to be at different temperatures, leading to a different expansion thereof which is controlled such that the lengths thereof are substantially equal.

According to a preferred embodiment the control unit is configured for controlling the cooling of at least one of said first cooling means and said second cooling means such that $|L1-L2|<60$ micron, preferably $|L1-L2|<40$ micron, or more preferably $|L1-L2|<30$ micron, wherein L1 is the length of said first light emitting area and L2 the length of said second light emitting area.

According to a preferred embodiment the system further comprises a measurement device configured for measuring at least one measure representative for a difference between a first and second length of the first and second light emitting area, respectively. The control unit may then be configured for controlling the cooling of at least one of said first cooling means and said second cooling means based on said at least one measure. In that way a closed-loop system can be obtained allowing for a very accurate control of the length of the first and/or second light emitting area. The measurement device may comprise e.g. any one of the following: a camera, an optical density sensor, an interference pattern measurement device, a spectrograph measurement device. Preferably said at least one measure is derived from an image printed by said first and second light emitting units, said image being such that the difference between the first and second length of the first and second light emitting area can be derived therefrom. This may be any image, i.e. a predetermined pattern (e.g. a line or marker), or more generally any image that allows for such a derivation. Such a derivation may also be performed during normal operation of the printer on the basis of the images that are being printed.

In an exemplary embodiment the measurement device comprises a first left and right optical measurement device for measuring a first set of positions of a left and right boundary of the first light emitting area, and a second set of positions of a left and right boundary of the second light emitting area; said first set being a first measure and said second set being a second measure of said at least one measure. In another exemplary embodiment the optical measurement device comprises at least one camera for measuring a first and second set of positions of a left and right marker printed by said first and second light emitting unit, respectively, said first set and said second set being said at least one measure. In yet another exemplary embodiment the measurement device comprises at least one optical sensor for measuring at least one measure representative for a difference between the length of the first and second light emitting area. According to a further exemplary embodiment the system may be adapted to print a predetermined pattern comprising areas in a first color and areas in a second color, wherein the first light emitting unit is used for printing in the first color and the second light emitting device is used for printing in the second color. By performing optical measurements of the printed pattern, such as measurements of an interference pattern or measurements using a spectral filter, a difference in length between the first and the second light emitting area may be determined.

In an exemplary embodiment the system further comprises a first temperature sensor for measuring a first temperature of the first light emitting unit and a second temperature sensor for measuring a second temperature of the second light emitting unit. The control circuit may then be further configured for controlling at least one of the first cooling means and the second cooling means in function of the measured first and second temperature. This may further improve the accurateness of the control unit.

In an exemplary embodiment the first light emitting unit comprises a first carrier on which a first plurality of light emitting array ICs is arranged, wherein the first cooling means is arranged for cooling said first carrier; and the second light emitting unit comprises a second carrier on which a second plurality of light emitting array ICs is arranged, wherein the second cooling means is arranged for cooling said second carrier. Preferably, the control unit is configured for determining a suitable temperature of at least one of the first carrier and the second carrier in function of a desired length of at least one of the first light emitting area and the second light emitting area; and for controlling at least one of the first cooling means and the second cooling means such that at least one of the first carrier and the second carrier is at the determined suitable temperature. In an exemplary embodiment, the first carrier comprises a heat sink of the first cooling means, and the second carrier comprises a heat sink of the second cooling means. In an embodiment with first and second temperature sensors, the control unit may control a cooling degree of the first and second cooling means such that cooling is increased or decreased if at least one of the measured first and second temperature is below or above a first and second determined suitable value, respectively.

In an exemplary embodiment the first cooling means comprises: a liquid cooling circuit arranged for cooling the first carrier with liquid; an air cooler for cooling said liquid; and a sensor for measuring a temperature of the liquid. The control unit may then be configured for regulating the air cooler such that said first light emitting area has a desired length. More generally, in an exemplary embodiment the first and second cooling means may each comprise an active air cooling circuit and/or a liquid cooling circuit.

In an exemplary embodiment the first light emitting unit comprises a first lens block for focusing the outputs of the first plurality of light emitting array ICs on a photosensitive member; and the second light emitting unit comprises a second lens block for focusing the outputs of the second plurality of light emitting array ICs on said photosensitive member, wherein the first and second lens block each comprise a plurality of rod lenses, preferably an array of selfoc lenses.

According to another aspect of the invention there is provided a printing apparatus comprising an embodiment of the system disclosed above.

According to a further aspect of the invention there is provided a method for controlling an image reproduction system comprising at least a first light emitting unit and a second light emitting unit, said first light emitting unit having a first light emitting area; said second light emitting unit having a second light emitting area. The method comprises: actively cooling said first light emitting unit; actively cooling said second light emitting unit independently of said first light emitting unit; controlling at least one of actively cooling said first light emitting unit and actively cooling said second light emitting unit, such that at least one of said first light emitting area and said second light emitting area, respectively, has a desired length.

In an exemplary embodiment the controlling comprises controlling at least one of actively cooling said first light emitting unit and actively cooling said second light emitting unit such that the length of said first light emitting area is substantially equal to the length of said second light emitting area.

In an exemplary embodiment the controlling comprises controlling at least one of actively cooling said first light emitting unit and actively cooling said second light emitting unit such that $|L1-L2|<60$ micron, preferably $|L1-L2|<40$ micron, or more preferably $|L1-L2|<30$ micron, wherein L1 is the length of said first light emitting area and L2 the length of said second light emitting area.

In an exemplary embodiment the method further comprises: measuring at least one measure representative for a difference between a first and second length of the first and second light emitting area, respectively; wherein the controlling comprises controlling at least one of actively cooling said first light emitting unit and actively cooling said second light emitting unit based on said at least one measure.

In an exemplary embodiment thereof the method further comprises: measuring a first set of positions of a left and right boundary of the first light emitting area; and a second set of positions of a left and right boundary of the second light emitting area; said first set and said second set being said at least one measure.

In another exemplary embodiment thereof the method further comprises: measuring a pattern printed by said first and second light emitting unit, and deriving at least one measure from said measured pattern representative for a difference between the first and second length of the first and second light emitting area.

In an exemplary embodiment the first light emitting unit comprises a first carrier on which a first plurality of light emitting array ICs is arranged, and the second light emitting unit comprises a second carrier on which a second plurality of light emitting array ICs is arranged; wherein actively cooling said first light emitting unit comprises actively cooling said first carrier; and wherein actively cooling said second light emitting unit comprises actively cooling said second carrier.

In an exemplary embodiment the method further comprises: determining a suitable temperature of at least one the first light emitting unit and the second light emitting unit in function of a desired length of at least one of the first light emitting area and the second light emitting area; wherein the controlling comprises controlling at least one of actively cooling said first light emitting unit and actively cooling said second light emitting unit such that at least one of the first light emitting unit and the second light emitting unit is at the determined suitable temperature.

In an exemplary embodiment the method further comprises: measuring a first temperature of the first light emitting unit and measuring a second temperature of the second light emitting unit; said controlling comprising controlling actively cooling said first light emitting unit and actively cooling said second light emitting unit based on a difference between a first suitable temperature and the first measured temperature and a difference between a second suitable temperature and the second measured temperature, respectively.

In exemplary embodiments of the invention, an embodiment of the method disclosed above may be performed e.g. during the calibration of a printing apparatus, and/or between subsequent print jobs of a printing apparatus, and/or during printing. When performed during printing, there may be made use of patterns or markers printed in a margin of the substrate to derive a measure for the difference between the length of the first and second light emitting area.

According to a further aspect of the invention, there is provided a computer program comprising computer-executable instructions to perform the method, when the program is run on a computer, according to any one of the steps of any one of the embodiments disclosed above.

According to a further aspect of the invention, there is provided a computer device or other hardware device programmed to perform one or more steps of any one of the embodiments of the method disclosed above. According to another aspect there is provided a data storage device encoding a program in machine-readable and machine-executable form to perform one or more steps of any one of the embodiments of the method disclosed above.

DETAILED DESCRIPTION OF EMBODIMENTS

Figure 1:
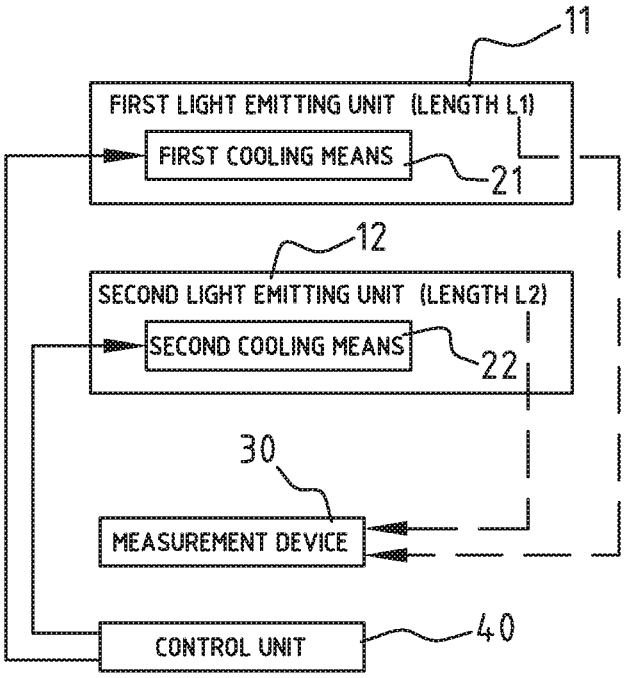
FIG. 1 is a schematic view of an exemplary embodiment of a system of the invention.

FIG. 1 illustrates an exemplary embodiment of a system for use in image reproduction. The system comprises a first light emitting unit 11, a second light emitting unit 12, and a control unit 40. In practice there may be provided more than two light emitting units and the respective light emitting units may be intended for printing the same color or a different color.

The first light emitting unit 11 comprises a first cooling means 21 arranged for cooling the first light emitting unit 11. The second light emitting unit 12 comprises a second cooling means 22 arranged for cooling the second light emitting unit 12 independently of the first light emitting unit 11 in the sense that the first and second cooling means allow the first light emitting unit 11 to be cooled at a different temperature than the second light emitting unit 12. The first light emitting unit 11 has a first elongate emitting area with a length L1. The second light emitting unit 12 has a second elongate emitting area with a length L2.

The control unit 40 is configured for controlling the cooling of at least one of the first cooling means 21 and the second cooling means 22 such that at least one of the first elongate emitting area and the second elongate emitting area, respectively, has a desired length. In that way, when an operator has measured e.g. a length of a bar printed by the first light emitting unit 11, he may set as a desired length for the second light emitting unit 12 the measured length, and the control unit may control the second cooling means 22 such that the second elongate emitting area has the desired length. In that way it can be ensured that the first length L1 of the first elongate emitting area is substantially the same as the second length L2 of the second elongate emitting area. For facilitating the measuring there may be provided a measurement device 30 configured for measuring a first and a second measure representative for a first and second length L1, L2 of the first and second light emitting area, respectively. The control unit 40 may then be configured for controlling the cooling of at least one of the first cooling means 21 and the second cooling means 22 based on said first measure and said second measure. Preferably, the control unit 40 is configured for controlling the cooling of at least one of the first cooling means 21 and the second cooling means 22 such that the length L1 of the first light emitting area is substantially equal to the length L2 of the second light emitting area. It is noted that the first cooling means 21 could be configured to cool at a constant rate, in which case the second cooling means 22 may be controlled by the control unit 40. Alternatively, the first and second cooling means 21, 22 may be controlled so that L1 and L2 are substantially equal to a preset desired length L. In a preferred embodiment the control unit 40 is configured for controlling the cooling of at least one of said first cooling means 21 and said second cooling means 22 such that $|L1-L2|<60$ micron, preferably $|L1-L2|<40$ micron, or more preferably $|L1-L2|<30$ micron, wherein L1 is the length of said first light emitting area and L2 the length of said second light emitting area. In other words, L1 is the length between the leftmost light emitting device that is being used and the rightmost light emitting device that is being used of the first light emitting unit 11, and L2 is the length between the leftmost light emitting device that is being used and the rightmost light emitting device that is being used of the second light emitting unit 12.

Figure 2A:
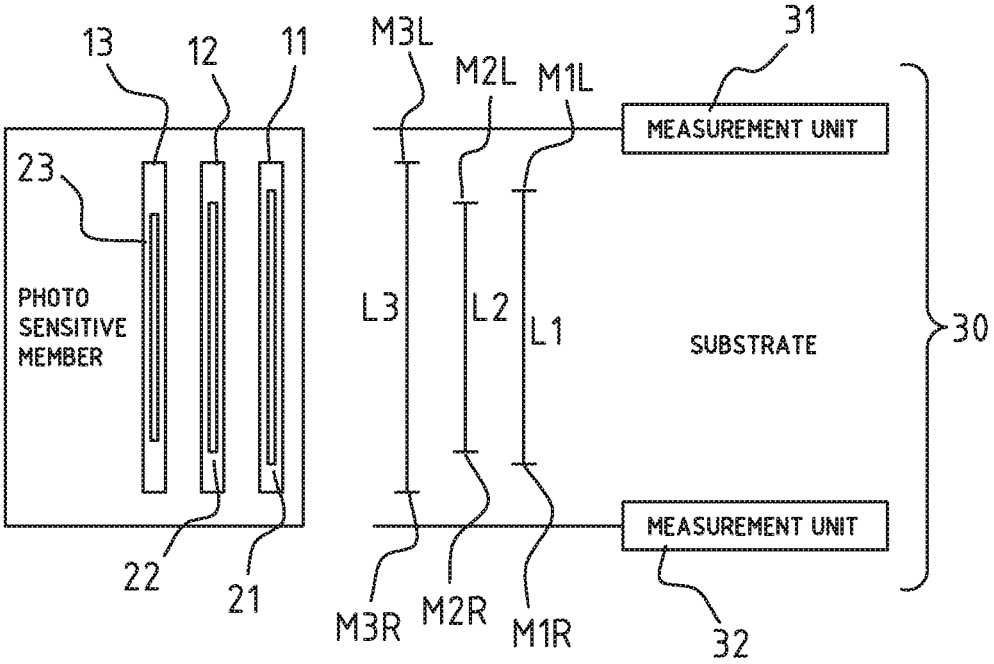
FIG. 2A is a schematic top view of a first exemplary embodiment of a measurement device of embodiments of the invention.

FIG. 2A illustrates a first exemplary embodiment of the measurement device 30. The measurement device 30 comprises a first and a second measurement unit 31, 32, e.g. a camera 31, 32, for measuring positions of a left and right marker M1L, M1R; M2L, M2R; M3L, M3R printed on a substrate by a plurality of light emitting units 11, 12, 13 which illuminate a photosensitive member, respectively, wherein the illuminated image on the photosensitive member is transferred using transfer means (not illustrated) on the substrate. The positions M1L, M1R are a first measure for a bar with a length L1 printed by a first light emitting unit 11. The positions M2L, M2R are a second measure for a bar with a length L2 printed by a second light emitting unit 12. The positions M3L, M3R are a third measure for a bar with a length L3 printed by a third light emitting unit 13. The control unit 40 (not shown in FIG. 2A) may be configured for controlling at least two of first cooling means 21 of the first light emitting unit 11, second cooling means 22 of the second light emitting unit 12, and third cooling means 23 of the third light emitting unit 13, based on said first measure, said second measure and third measure, such that the length L1 is substantially equal to the length L2 and to the length L3.

Figure 2B:
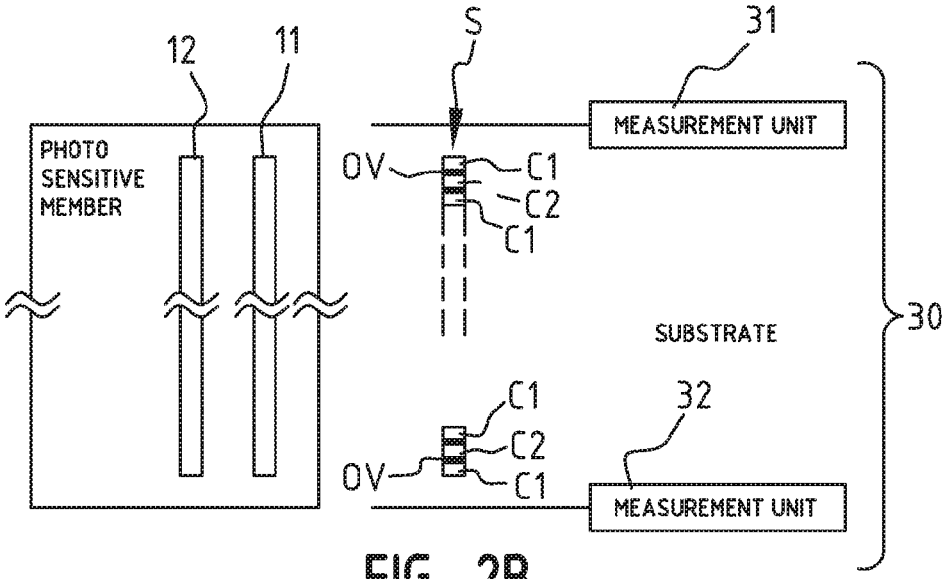
FIG. 2B is a schematic top view of a second exemplary embodiment of a measurement device of embodiments of the invention.

FIG. 2B illustrates a second exemplary embodiment of a measurement device 30. The measurement device 30 comprises a first and a second measurement unit 31, 32, e.g. a camera, an optical density sensor, an interference pattern measurement device, or a spectrograph measurement device. The system is configured for printing a predetermined pattern, e.g. a strip S comprising adjacent blocks in a first color C1 associated with a first light emitting unit 11 and a second color C2 associated with a second light emitting unit 12. If the length L1, L2 of the light emitting areas of the first and second light emitting units 11 and 12 are identical the overlap OV between a block in a first color C1 and a block in a second color C2 is zero or negligible. However, if the lengths L1 and L2 are different, there will be an amount of overlap OV between adjacent blocks. This can be measured by suitable optical measurement devices 31, 32. Although left and right measurement devices 31, 32 are preferred, one measurement device 31 or 32 may be sufficient since the expansion in the left and right directions is typically substantially the same. The measurement devices 31, 32 measure the overlap OV between adjacent blocks printed on a substrate by the light emitting units 11, 12 which illuminate a photosensitive member, wherein the illuminated image on the photosensitive member is transferred using transfer means (not illustrated) on the substrate. The overlap OV is a measure for the difference between length L1 and length L2. The control unit 40 (not shown in FIG. 2B) may be configured for controlling at least one of a first cooling means 21 of the first light emitting unit 11, and a second cooling means 22 of the second light emitting unit 12, based on said measure.

Figure 3:
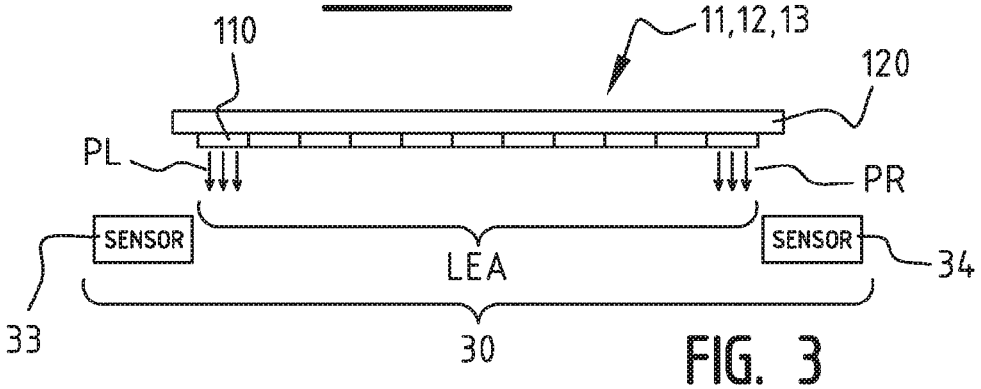
FIG. 3 is a schematic side view of an exemplary embodiment of a light emitting unit with a measurement device for use in an embodiment of a system of the invention.

FIG. 3 illustrates a second exemplary embodiment of the measurement device 30. The measurement device 30 comprises a first left and right optical sensor 33, 34 for measuring a first set of positions PL, PR of a left and right boundary of the light emitting area LEA of a light emitting unit 11, 12, 13 with a carrier 120 on which a plurality of LED array ICs 110 are arranged. Each light emitting unit 11, 12, 13 may be provided with similar left and right optical sensors. The positions PL, PR are a measure for a length L of an emitting area LEA of the respective light emitting unit 11, 12, 13. The control unit 40 (not shown in FIG. 3) may be configured for controlling at least two of first cooling means of the first light emitting unit 11, second cooling means of the second light emitting unit 12, and third cooling means of the third light emitting unit 13, based on said measures, such that the lengths corresponding with the respective light emitting units 11, 12, 13 are equal.

In FIGS. 2A, 2B and 3 exemplary embodiments with two and three light emitting units have been illustrated but the skilled person understands that the illustrated measurement devices are equally applicable in systems with more than three light emitting units.

Figure 4:
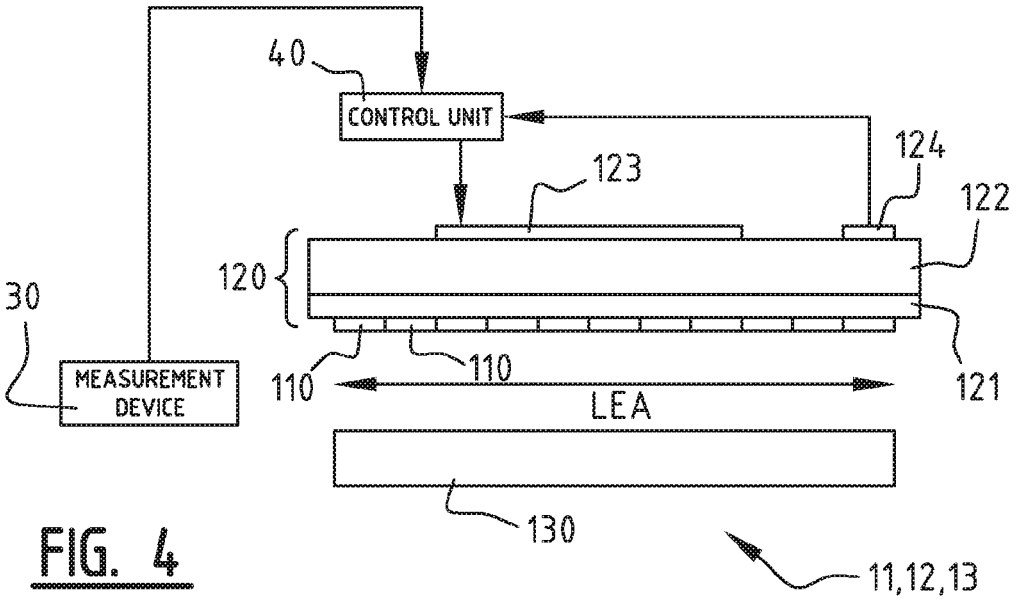
FIG. 4 is a schematic view of an exemplary embodiment of a light emitting unit for use in an embodiment of a system of the invention.

FIG. 4 illustrates in more detail an exemplary embodiment of a light emitting unit 11, 12, 13. The light emitting unit 11, 12, 13 comprises a carrier 120 on which a first plurality of light emitting array ICs 110 is arranged. The light emitting unit 11, 12, 13 comprises a cooling means 123, e.g. a fan, which is arranged for cooling the carrier 120. The carrier 120 may comprise a heat sink 122 for the cooling means, e.g. an Al heat sink 122. The carrier 120 may further comprise a PCB 121 on which the LED arrays 110 are arranged. There may be arranged a temperature sensor 124 on the carrier 120 for measuring a temperature T of the carrier 120. The control unit 40 may then be configured for controlling the cooling means 123 such that a cooling degree thereof is increased or decreased if the measured temperature T is above or below a predetermined value Tdes which is a function of the desired length of the light emitting area LEA. It is noted that if a desired length is set, the control unit 40 may be configured for determining a suitable temperature Tdes of the carrier 120 in function of the desired length of the light emitting area LEA, and for controlling the cooling means 123 such that the carrier 120 is at the determined suitable temperature. Alternatively or in addition, there may be performed a measurement by the measurement device 30 of the length of the light emitting area LEA, and the control unit 40 may then be configured for controlling the cooling means 123 such that a cooling degree thereof is increased or decreased if the measured length is above or below the desired length. The light emitting unit 11, 12, 13 further comprises a lens block 130 for focusing the outputs of the plurality of light emitting array ICs 110 on a photosensitive member, wherein the lens block 130 comprises a plurality of rod lenses, preferably an array of selfoc lenses.

Figure 5:
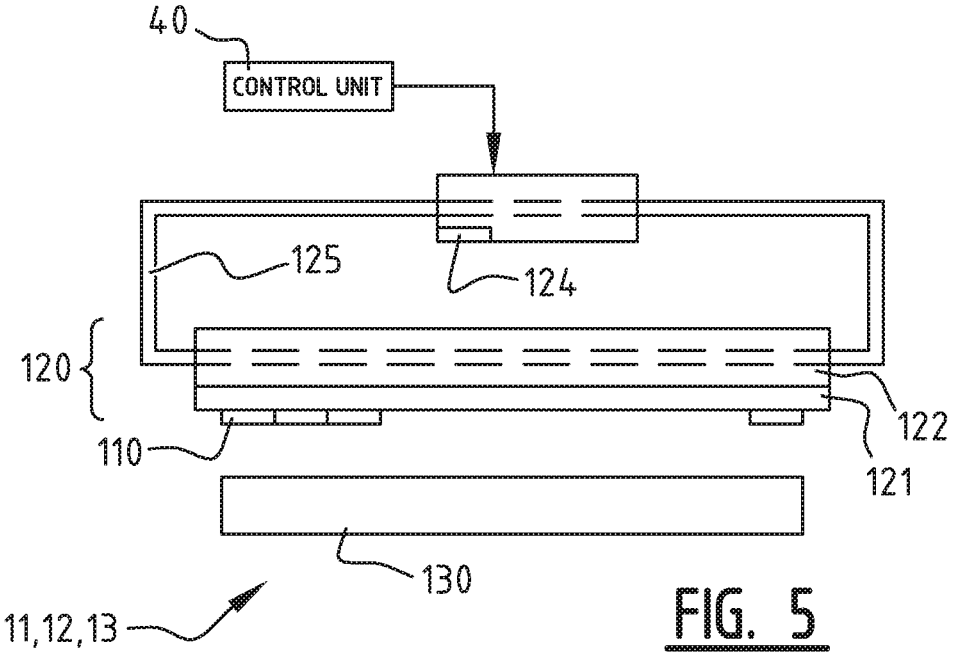
FIG. 5 is a schematic view of another exemplary embodiment of a light emitting unit for use in an embodiment of a system of the invention.

Another exemplary embodiment of a light emitting unit 11, 12, 13 is illustrated in FIG. 5. The cooling means comprises a liquid cooling circuit 125 arranged for cooling a heat sink 122 of the carrier 120 with liquid; an air cooler 126 for cooling said liquid; and a sensor 124 for measuring a temperature of the liquid. The control unit 40 may then be configured for regulating the air cooler 126 such that said first light emitting area has a desired length.

Figure 6:
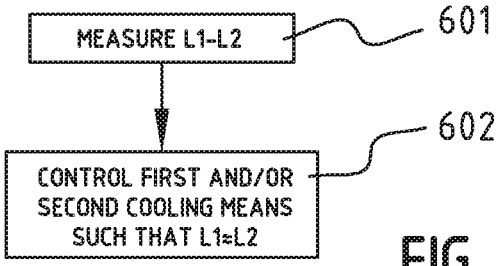
FIG. 6 is a schematic view of a first exemplary embodiment of a method of the invention.

FIG. 6 illustrates a first exemplary embodiment of a method for controlling an image reproduction system comprising at least a first light emitting unit and a second light emitting unit, said first light emitting unit having a first light emitting area with a length L1, and said second light emitting unit having a second light emitting area with a length L2. The method comprises actively cooling the first light emitting unit, and actively cooling the second light emitting unit independently of said first light emitting unit, in the sense that the first and second light emitting units can be cooled at a different rate. In the first exemplary embodiment of FIG. 6 the following steps are performed: measuring at least one measure representative for the difference between the first and second length L1, L2 of the first and second light emitting area, respectively, see step 601; and controlling at least one of actively cooling the first light emitting unit and actively cooling the second light emitting unit based on the at least one measure, such that at least one of said first light emitting area and said second light emitting area, respectively, has a desired length, and preferably such that L1 is substantially equal to L2, see step 602. In a preferred embodiment the controlling 602 comprises controlling at least one of actively cooling said first light emitting unit and actively cooling said second light emitting unit such that $|L1-L2|<60$ micron, preferably $|L1-L2|<40$ micron, or more preferably $|L1-L2|<30$ micron, wherein L1 is the length of said first light emitting area and L2 the length of said second light emitting area. The measuring 601 of a measure for L1 and L2 may comprise measuring a first set of positions of a left and right boundary of the first light emitting area; and a second set of positions of a left and right boundary of the second light emitting area, see also the embodiment of FIG. 2. Alternatively the measuring 601 may comprise measuring at least one pattern printed via said first and second light emitting unit, respectively, wherein said at least one pattern is such that the difference between the length L1 and L2 can be calculated therefrom.

Figure 7:
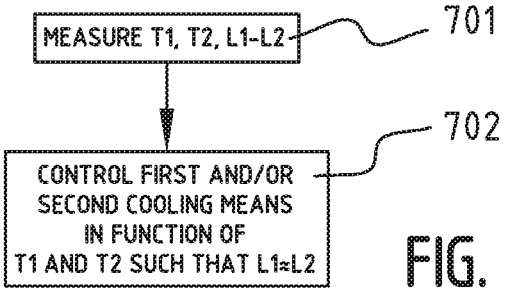
FIG. 7 is a schematic view of a second exemplary embodiment of a method of the invention.

FIG. 7 illustrates a second exemplary embodiment of a method for controlling an image reproduction system comprising at least a first light emitting unit and a second light emitting unit, said first light emitting unit having a first light emitting area with a length L1, and said second light emitting unit having a second light emitting area with a length L2. The method comprises actively cooling the first light emitting unit, and actively cooling the second light emitting unit independently of said first light emitting unit, in the sense that the first and second light emitting units can be cooled at a different rate. In the second exemplary embodiment of FIG. 7 the following steps are performed: measuring at least one measure representative for the difference between a first and second length L1, L2 of the first and second light emitting area, respectively, and measuring a first temperature T1 of the first light emitting unit and a second temperature T2 of the second light emitting unit, see step 701; and controlling at least one of actively cooling the first light emitting unit and actively cooling the second light emitting unit based on the at least one measure, T1, and T2, such that at least one of said first light emitting area and said second light emitting area, respectively, has a desired length, and preferably such that L1 is substantially equal to L2, see step 702. In a preferred embodiment the controlling 702 comprises controlling at least one of actively cooling said first light emitting unit and actively cooling said second light emitting unit such that $|L1-L2|<60$ micron, preferably $|L1-L2|<40$ micron, or more preferably $|L1-L2|<30$ micron, wherein L1 is the length of said first light emitting area and L2 the length of said second light emitting area. The controlling 702 may comprise determining a suitable temperature of at least one the first carrier and the second carrier in function of a desired length of at least one of the first light emitting area and the second light emitting area; and controlling at least one of actively cooling said first light emitting unit and actively cooling said second light emitting unit such that at least one of the first and the second light emitting unit is at the determined suitable temperature. More in particular the actively cooling of the first and second light emitting unit may be based on a difference between a first determined suitable temperature and a first measured temperature and a difference between a second determined suitable temperature and a second measured temperature, respectively.

A person of skill in the art would readily recognize that steps of various above-described methods can be performed by programmed computers. Herein, some embodiments are also intended to cover program storage devices, which are machine or computer readable and encode machine-executable or computer-executable programs of instructions, wherein said instructions perform some or all of the steps of said above-described methods.

The functions of the various elements shown in the figures, including any functional blocks labelled as "units", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "control unit" or "controller" should not be construed to refer exclusively to hardware capable of executing software, and may implicitly include, e.g. digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included.

Whilst the principles of the invention have been set out above in connection with specific embodiments, it is to be understood that this description is merely made by way of example and not as a limitation of the scope of protection which is determined by the appended claims.

The invention claimed is:

1. A system for use in image reproduction, said system comprising:

at least a first light emitting unit and a second light emitting unit; said first light emitting unit comprising a first cooling means arranged for cooling said first light emitting unit; said second light emitting unit comprising a second cooling means arranged for cooling said second light emitting unit independently of said first light emitting unit; said first light emitting unit having a first elongate emitting area; said second light emitting unit having a second elongate emitting area;

a control unit configured for controlling the cooling of at least one of said first cooling means and said second cooling means such that, when the first and second light emitting units have a different length at a same temperature, the first and second light emitting units are controlled to be at different temperatures, leading to a different expansion thereof which is controlled such that the lengths thereof are substantially equal.

2. The system of claim 1, wherein the control unit is configured for controlling the cooling of at least one of said first cooling means and said second cooling means such that $|L1-L2|<60$ micron, preferably $|L1-L2|<40$ micron, or more preferably $|L1-L2|<30$ micron, wherein L1 is the length of said first elongate light emitting area and L2 the length of said second elongate light emitting area.

3. The system of claim 1, further comprising a measurement device configured for measuring at least one measure representative for a difference between a first and second length of the first and second elongate light emitting area, respectively;

wherein said control unit is configured for controlling the cooling of at least one of said first cooling means and said second cooling means based on said at least one measure.

4. The system of claim 2, further comprising a measurement device configured for measuring at least one measure representative for a difference between a first and second length of the first and second elongate light emitting area, respectively;

wherein said control unit is configured for controlling the cooling of at least one of said first cooling means and said second cooling means based on said at least one measure.

5. The system of claim 4, wherein said measurement device comprises a left and right measurement unit for measuring a first set of positions of a left and right boundary of the first elongate light emitting area and a second set of positions of a left and right boundary of the second elongate light emitting area; said first set and said second set being said at least one measure.

6. The system of claim 4, wherein said measurement device comprises any one of the following: a camera, an optical density sensor, an interference pattern measurement device, a spectrograph measurement device.

7. The system of claim 1, further comprising a first temperature sensor for measuring a first temperature of the first light emitting unit and a second temperature sensor for measuring a second temperature of the second light emitting unit; said control circuit being further configured for controlling at least one of the first cooling means and the second cooling means in function of the measured first and second temperature.

8. The system of claim 1, wherein said first light emitting unit comprises a first carrier on which a first plurality of light emitting array ICs is arranged, and wherein said first cooling means is arranged for cooling said first carrier; wherein said second light emitting unit comprises a second carrier on which a second plurality of light emitting array ICs is arranged, and wherein said second cooling means is arranged for cooling said second carrier.

9. The system of claim 8, wherein the control unit is configured for determining a suitable temperature of at least one of the first carrier and the second carrier in function of a desired length of at least one of the first elongate light emitting area and the second elongate light emitting area; and for controlling at least one of the first cooling means and the second cooling means such that at least one of the first carrier and the second carrier is at the determined suitable temperature.

10. The system of claim 8, wherein the first carrier comprises a heat sink of the first cooling means, and the second carrier comprises a heat sink of the second cooling means.

11. The system of claim 8, wherein the first cooling means comprises:

a liquid cooling circuit arranged for cooling the first carrier with liquid;

an air cooler for cooling said liquid; and a sensor for measuring a temperature of the liquid;

wherein the control unit is configured for regulating the air cooler such that said first elongate light emitting area has a desired length.

12. A method for controlling an image reproduction system comprising at least a first light emitting unit and a second light emitting unit, said first light emitting unit having a first elongate light emitting area; said second light emitting unit having a second elongate light emitting area; said method comprising:

actively cooling said first light emitting unit;

actively cooling said second light emitting unit independently of said first light emitting unit;

controlling at least one of actively cooling said first light emitting unit and actively cooling said second light emitting unit, such that, when the first and second light emitting units have a different length at a same temperature, the first and second light emitting units are controlled to be at different temperatures, leading to a different expansion thereof which is controlled such that the lengths thereof are substantially equal.

13. The method of claim 12, wherein the controlling comprises controlling at least one of actively cooling said first light emitting unit and actively cooling said second light emitting unit such that $|L1-L2|<60$ micron, preferably $|L1-L2|<40$ micron, or more preferably $|L1-L2|<30$ micron, wherein L1 is the length of said first elongate light emitting area and L2 the length of said second elongate light emitting area.

14. The method of claim 12, further comprising:

measuring at least one measure representative for a difference between a first and second length of the first and second elongate light emitting area, respectively;

wherein the controlling comprises controlling at least one of actively cooling said first light emitting unit and actively cooling said second light emitting unit based on said at least one measure.

15. A computer program product comprising computer-executable instructions for performing one or more steps of the method of claim 12, when the program is run on a computer.

16. A system for use in image reproduction, said system comprising:

at least a first light emitting unit and a second light emitting unit; said first light emitting unit comprising a first cooling means arranged for cooling said first light emitting unit; said second light emitting unit comprising a second cooling means arranged for cooling said second light emitting unit independently of said first light emitting unit; said first light emitting unit having a first elongate emitting area; said second light emitting unit having a second elongate emitting area;

a measurement device configured for measuring at least one measure representative of a difference between a first and second length of the first and second elongate light emitting area, respectively;

a control unit configured for controlling the cooling of at least one of said first cooling means and said second cooling means based on said at least one measure;

wherein said measurement device comprises any one of the following: a camera, an optical density sensor, an interference pattern measurement device, a spectrograph measurement device.

17. The system of claim 16, further comprising a first temperature sensor for measuring a first temperature of the first light emitting unit and a second temperature sensor for measuring a second temperature of the second light emitting unit; said control circuit being further configured for controlling at least one of the first cooling means and the second cooling means in function of the measured first and second temperature.

18. The system of claim 16, wherein the control unit is configured for controlling the cooling of at least one of said first cooling means and said second cooling means such that, when the first and second light emitting units have a different length at a same temperature, the first and second light emitting units are controlled to be at different temperatures, leading to a different expansion thereof which is controlled such that the lengths thereof are substantially equal.

19. The system of claim 16, wherein the control unit is configured for controlling the cooling of at least one of said first cooling means and said second cooling means such that $|L1-L2|<60$ micron, preferably $|L1-L2|<40$ micron, or more preferably $|L1-L2|<30$ micron, wherein L1 is the length of said first elongate light emitting area and L2 the length of said second elongate light emitting area.

* * * * *